US007540495B2

(12) United States Patent
Okuda et al.

(10) Patent No.: US 7,540,495 B2
(45) Date of Patent: Jun. 2, 2009

(54) FEEDER PROVIDED WITH EDGE GUIDE MEMBER

(75) Inventors: Yasumichi Okuda, Nagano (JP); Yoshihiro Kobayashi, Nagano (JP); Kazuhito Hori, Nagano (JP); Naohiro Ueyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 397 days.

(21) Appl. No.: 11/241,101

(22) Filed: Sep. 29, 2005

(65) Prior Publication Data

US 2006/0091599 A1 May 4, 2006

(30) Foreign Application Priority Data

Sep. 29, 2004 (JP) ..... P2004-283130

(51) Int. Cl.
*B65H 1/00* (2006.01)

(52) U.S. Cl. ..... 271/171

(58) Field of Classification Search ..... 271/171, 271/145, 248, 253, 240; 400/601, 633, 633.2, 400/642, 632.2
See application file for complete search history.

(56) References Cited

U.S. PATENT DOCUMENTS

| | | | | |
|---|---|---|---|---|
| 7,422,206 | B2 * | 9/2008 | Okuda et al. | 271/121 |
| 2003/0178764 | A1 * | 9/2003 | Hasegawa | 271/171 |
| 2004/0056413 | A1 * | 3/2004 | Shirakura et al. | 271/145 |
| 2006/0071388 | A1 * | 4/2006 | Okuda et al. | 271/8.1 |

FOREIGN PATENT DOCUMENTS

| | | | |
|---|---|---|---|
| JP | 03102016 | * | 4/1991 |
| JP | 5-12428 | | 2/1993 |
| JP | 2004307105 | * | 11/2004 |
| JP | 2005112497 | * | 4/2005 |

* cited by examiner

*Primary Examiner*—Patrick H Mackey
*Assistant Examiner*—Patrick Cicchino
(74) *Attorney, Agent, or Firm*—Edwards Angell Palmer & Dodge LLP; John J. Penny, Jr.

(57) ABSTRACT

A feeder is adapted to feed a medium to a down stream section in a first direction. A feeding tray has a supporting face adapted to support the medium thereon and formed with a groove. A first edge guide is provided on the supporting face so as to be slidable in a second direction perpendicular to the first direction. A second edge guide is provided on the supporting face so as to oppose to the first edge guide, so that the medium is placed therebetween. An auxiliary guide body is provided in the first edge guide and having a projection slidably engaged with the groove, the auxiliary guide body being slidable relative to the first edge guide in the first direction and a third direction opposite to the first direction, in accordance with the slide movement of the first edge guide in the second direction by way of the engagement between the projection and the groove. The auxiliary guide body has a guiding face projected from the first edge guide in the first direction when a distance between the first edge guide and the second edge guide is no greater than a first prescribed value and adapted to be brought into contact with one of the side edges of the medium.

10 Claims, 8 Drawing Sheets

FEEDER PROVIDED WITH EDGE GUIDE MEMBER

BACKGROUND OF THE INVENTION

The present invention relates to an edge guide member in a feeder which is incorporated in a recording apparatus for feeding a recording medium to a recording section at which recording is performed on the recording medium. The invention also relates to an edge guide member in a feeder which is incorporated in a liquid ejecting apparatus such as an ink jet recording apparatus for feeding a target medium to a section at which liquid is ejected from a liquid ejecting head toward the target medium.

The term "liquid ejecting apparatus" as used herein includes not only recording apparatus such as a printer, a copier, and a facsimile machine that use an ink jet recording head and perform recording on a recording material by ejecting ink from the recording head but also an apparatus that ejects liquid suitable for a purpose instead of ink from a liquid ejecting head toward a target material and thereby cause the liquid to land on the target material.

Examples of the liquid ejecting head other than the recording head are a colorant ejecting head used for manufacture of color filters of a liquid crystal display or the like, an electrode material (conductive paste) ejecting head used for formation of electrodes of an organic EL display, a field emission display (FED), or the like, a bioorganic material ejecting head used for manufacture of a biochip, and a sample ejecting head as precision pipettes.

In the recording apparatus such as an ink jet printer, recording media such as sheets are stacked on a hopper and automatically fed to a recording section side one by one by vertical movements of the hopper and rotational driving by a feeding roller. The hopper is provided with edge guides. Recording media can be fed without being skewed by setting the edge guides adjacent to the sidelines (edges) of the recording media in accordance with the size of the recording media.

Japanese Utility Model Publication No. 5-12428U discloses a device wherein an edge guide movable in the sheet medium width direction is provided so as to extend parallel with the side edges of sheets. The edge guide is equipped with a retractable limiter which projects from a guiding face of the edge guide toward the side edges of sheets. When sheets are set, the gap between the guiding face and the sheets is set by bringing the limiter into contact with the sheets. As a result, no friction occurs between the sheets and the guiding face and skewing is prevented.

On the other hand, in recent years, a single recording apparatus has come to perform recording on sheets having a wide range of size (e.g., from the B4 size to the name card size). In such a recording apparatus, the feeder is required to feed sheets of various sizes without skewing them. One countermeasure would be elongate the edge guides to prevent skewing, which, however, raises a problem that the size of the feeder itself is increased.

SUMMARY OF THE INVENTION

It is therefore an object of the invention to provide a feeder provided with an edge guide member capable of guiding recording media of various sizes without skewing them.

In order to achieve the above object, according to the invention, there is provided a feeder, adapted to feed a medium to a down stream section in a first direction, comprising:

a feeding tray, having a supporting face adapted to support the medium thereon and formed with a groove;

a first edge guide, provided on the supporting face so as to be slidable in a second direction perpendicular to the first direction;

a second edge guide, provided on the supporting face so as to oppose to the first edge guide, so that the medium is placed therebetween; and an auxiliary guide body, provided in the first edge guide and having a projection slidably engaged with the groove, the auxiliary guide body being slidable relative to the first edge guide in the first direction and a third direction opposite to the first direction, in accordance with the slide movement of the first edge guide in the second direction by way of the engagement between the projection and the groove, the auxiliary guide body having a guiding face projected from the first edge guide in the first direction when a distance between the first edge guide and the second edge guide is no greater than a first prescribed value and adapted to be brought into contact with one of the side edges of the medium.

The first value may correspond to a width of a shorter dimension of a postcard.

A projected length of the guiding face may be varied in accordance with the distance between the first edge guide and the second edge guide.

With the above configurations, when the medium is small like post cards or name cards, as the first edge guide is moved so as to accommodate their width, the projection is guided by the groove and the auxiliary guide body projects from the body in the medium feeding direction. Therefore, the associated side edge of each small media can be guided by the auxiliary guide body without being skewed until the feeding operation is completed.

The second edge guide may be fixed on the supporting face. In this case, both side edges of the medium can be guided merely by bringing one side edge of the medium into contact with the second edge guide and then moving the first edge guide in the first direction.

The guiding face may be projected from the first edge guide in the third direction when the distance between the first edge guide and the second edge guide is no less than a second prescribed value which is greater than the first prescribed value.

In this case, when the medium is large like B4 or A3 paper, as the first edge guide is moved so as to accommodate their width, the projection is guided by the groove and the auxiliary guide body projects from the body in the direction opposite to the medium feeding direction. Therefore, the associated side edge of a top portion of each large recording medium can be guided by the auxiliary guide body without being skewed from the beginning of the feeding operation.

According to the invention, there is also provided A feeder, adapted to feed a medium to a down stream section in a first direction, comprising:

a feeding tray, having a supporting fare adapted to support the medium thereon and formed with a groove;

a first edge guide, provided on the supporting face so as to be slidable in a second direction perpendicular to the first direction;

a second edge guide, provided on the supporting face so as to oppose to the first edge guide, so that the medium is placed therebetween; and an auxiliary guide body, provided in the first edge guide and having a projection slidably engaged with the groove, the auxiliary guide body being slidable relative to the first edge guide in the first direction and a third direction opposite to the first direction, in accordance with the slide movement of the first edge guide in the second direction by way of the engagement between the projection and the groove, the auxiliary guide body having a guiding face projected from the first edge guide in the third direction when a distance between the first edge guide and the second edge guide is no less than a first prescribed value and adapted to be brought into contact with one of the side edges of the medium.

The first value may correspond to a width of a shorter dimension of a B4 sheet of paper.

A projected length of the guiding face may be varied in accordance with the distance between the first edge guide and the second edge guide.

With the above configurations, when the medium is large like B4 or A3 paper, as the first edge guide is moved so as to accommodate their width, the projection is guided by the groove and the auxiliary guide body projects from the body in the direction opposite to the medium feeding direction. Therefore, the associated side edge of a top portion of each large recording medium can be guided by the auxiliary guide body without being skewed from the beginning of the feeding operation.

The second edge guide may be fixed on the supporting face. In this case, both side edges of the medium can be guided merely by bringing one side edge of the medium into contact with the second edge guide and then moving the first edge guide in the first direction.

The guiding face may be projected from the first edge guide in the first direction when the distance between the first edge guide and the second edge guide is no greater than a second prescribed value which is smaller than the first prescribed value.

In this case, when the medium is small like post cards or name cards, as the first edge guide is moved so as to accommodate their width, the projection is guided by the groove and the auxiliary guide body projects from the body in the medium feeding direction. Therefore, the associated side edge of each small media can be guided by the auxiliary guide body without being skewed until the feeding operation is completed.

According to the invention, there is also provided a feeder, adapted to feed a medium to a down stream section in a first direction, comprising:

a feeding tray, having a supporting face adapted to support the medium thereon and formed with a groove;

a first edge guide, provided on the supporting face so as to be slidable in a second direction perpendicular to the first direction;

a second edge guide, provided on the supporting face so as to oppose to the first edge guide, so that the medium is placed therebetween; and a manipulator, adapted to be manipulated by a user's finger to slide at least a part of one of the first edge guide and the second edge guide in the first direction and a third direction opposite to the first direction.

With this configuration, a medium having an arbitrary length can be guided properly by manipulating the manipulator with a finger to adjust the position of the first edge guide in the first and third directions. This makes it possible to prevent the medium from skewing during the feeding operation.

According to the invention, there is also provided a recording apparatus incorporating the above feeder and comprising a recording head, disposed in the downstream section and operable to record information on the medium fed by the feeder.

According to the invention, there is also provided a liquid ejecting apparatus incorporating the feeder and comprising a liquid ejecting head, disposed in the downstream section and operable to eject liquid toward the medium fed by the feeder.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Figure 1:
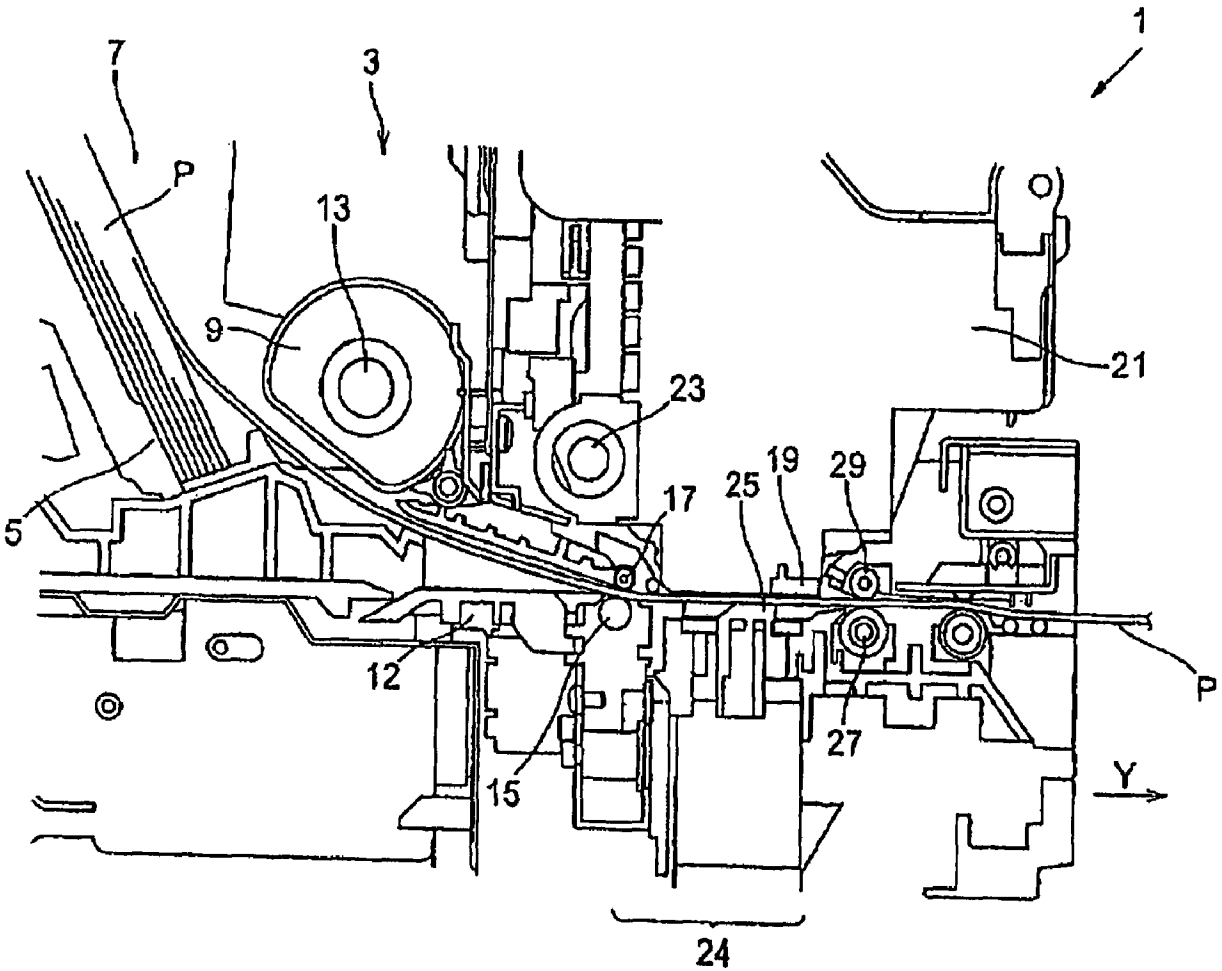
FIG. 1 is a schematic section view of an internal structure of an ink jet printer according to a first embodiment of the invention.

Embodiments of the invention will be described below in detail with reference to the accompanying drawings.

A first embodiment of the invention will be described for a case that a feeder provided with an edge guide member is applied to an ink jet printer.

An ink jet printer 1 is equipped with a feeder 3 on the rear side and the feeder 3 is equipped with a feeding tray 7 having a supporting face 5 for recording media P. Recording media P before being subjected to recording are stacked on the feeding tray 7. During a feeding operation, the recording media P are pressed against the outer circumferential face of a feeding roller 9 by a hopper that is moved toward the feeding roller 9 at prescribed timings. As the feeding roller 9 is driven to rotate on a rotary shaft 13, the recording media P being pressed against the outer circumferential face of the feeding roller 9 is automatically fed one by one toward a position where a transporting drive roller 15 and a transporting follower roller 17 are in contact with each other while being guided by a guide member 12.

The recording medium P is nipped by the transporting drive roller 15 and the transporting follower roller 17 and is pressed against and brought in close contact with a high-frictional-resistance coating face of the transporting drive roller 15. As the transporting drive roller 15 rotates in a direction corresponding to a secondary scanning direction Y, the recording medium P is transported in the secondary scanning direction Y by a transport length corresponding to an amount of rotation of the transporting drive roller 15.

The ink jet printer 1 has a recording section 24. The recording section 24 is equipped with a carriage 21 for scanning, in a primary scanning direction X (i.e., the direction perpendicular to the paper face of FIG. 1), a recording medium P with a recording head 19 which performs recording by ejecting ink to the recording medium P. The carriage 21 is pivotally supported by a guide shaft 23 so as to reciprocate in the primary scanning direction X. Rotational driving power generated by a carriage motor is transmitted to the carriage 21 by a belt transmission mechanism (not shown), whereby the carriage 21 reciprocates in the primary scanning direction X.

Ink cartridges storing ink of respective colors are mounted on the carriage 21 detachably, and ink of the respective colors are supplied from the ink cartridges to the recording head 19. The head face of the recording head 19 reciprocates in the primary scanning direction X at such a position as to be opposed to a platen 25, and recording is performed in such a manner that ink drops are ejected toward a recording medium P being transported on the platen 25 from nozzles arranged in the head face. The recording medium P the recording on which has completed is transported in the secondary scanning direction Y and thereby ejected by an ejecting drive roller 27 and an ejecting follower roller 29.

Next, detailed description will be made of the configuration of the edge guide member. In the following description, the primary scanning direction X and the secondary scanning direction Y will be will be referred to as a medium width direction and a medium feeding direction, respectively. To facilitate understanding, in this embodiment, it is assumed that all recording media are fed in their longitudinal direction.

A movable edge guide 31 capable of sliding in the medium width direction in accordance with the width dimension of recording media to be fed is provided on the supporting face of the feeding tray 7. The movable edge guide 31 has a body 33 which extends perpendicularly to the supporting face 5, and the body 33 is formed with a guiding face 35 which extends parallel with the medium feeding direction.

A fixed edge guide 39 having another guiding face 37 which extends parallel with the medium feeding direction is formed at such a position as to be opposed to the movable edge guide 31. A medium placement region 41 is formed between the movable edge guide 31 and the fixed edge guide 39. Plural recording media P to be fed one by one can be stacked on the medium placement region 41. The fixed edge guide 39 may be configured to be a movable edge guide.

The body 33 of the movable edge guide 31 is provided with an auxiliary guide body 43 which can project from the body 33 in the medium feeding direction and in the direction opposite to it. A projection 45 projects from the bottom face of the auxiliary guide body 43 toward the supporting face 5. On the other hand, the supporting face 5 is formed with a groove 47 which receives and guides the projection 45.

Figure 3:
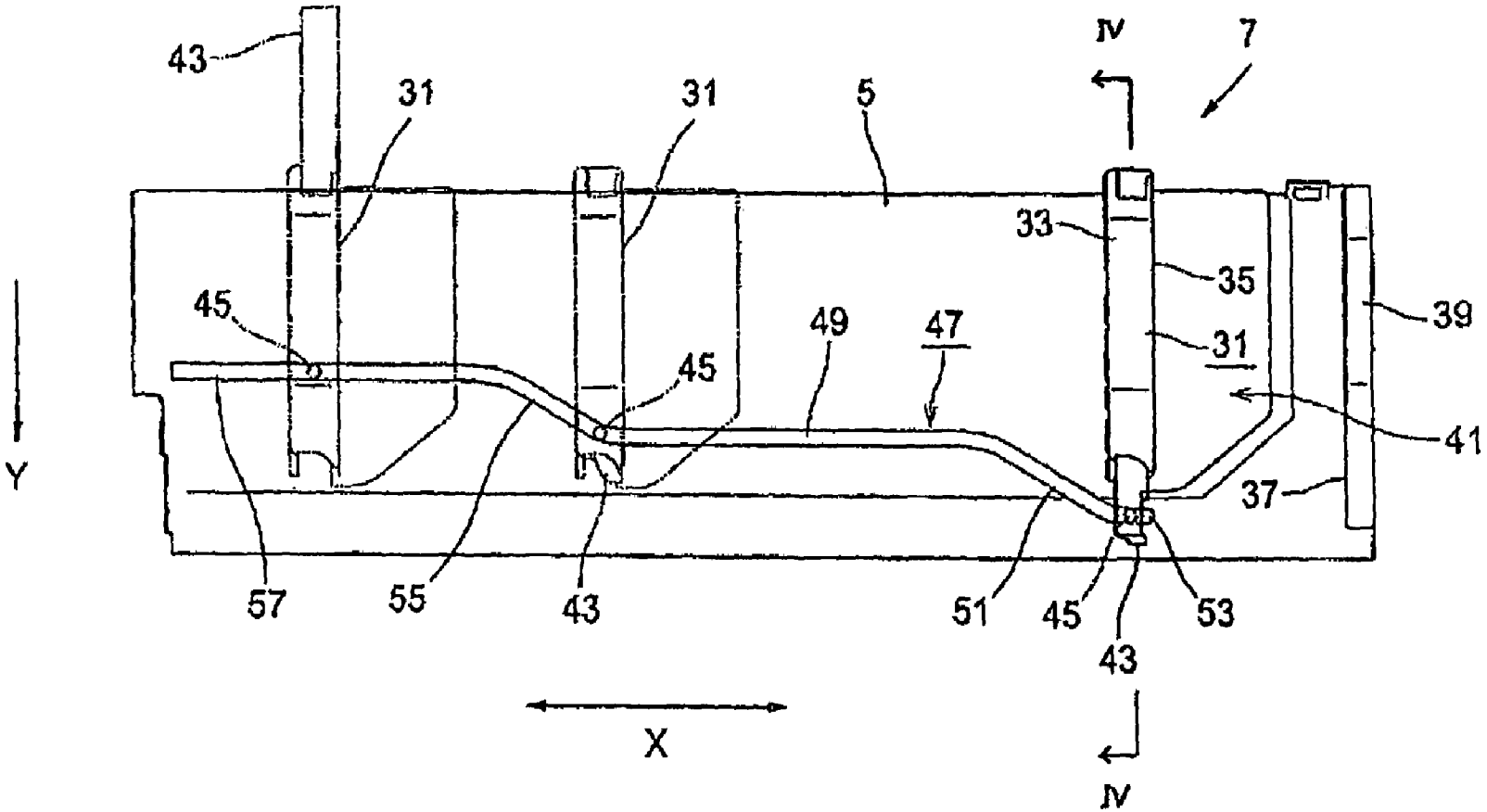
FIG. 3 is a top view of a feeder in the ink jet printer of FIG. 1.

As shown in FIG. 3, the groove 47 has a central region 49, a lower stage region 53 which is located on the right of the central region 49 and connected to the central region 49 via a slope region 51, and an upper stage region 57 which is located on the left of the central region 49 and connected to the central region 49 via a slope region 55. All of the upper stage region 57, the central region 49 and the lower stage region 52 are extending parallel with the primary scanning direction X.

Figure 4:
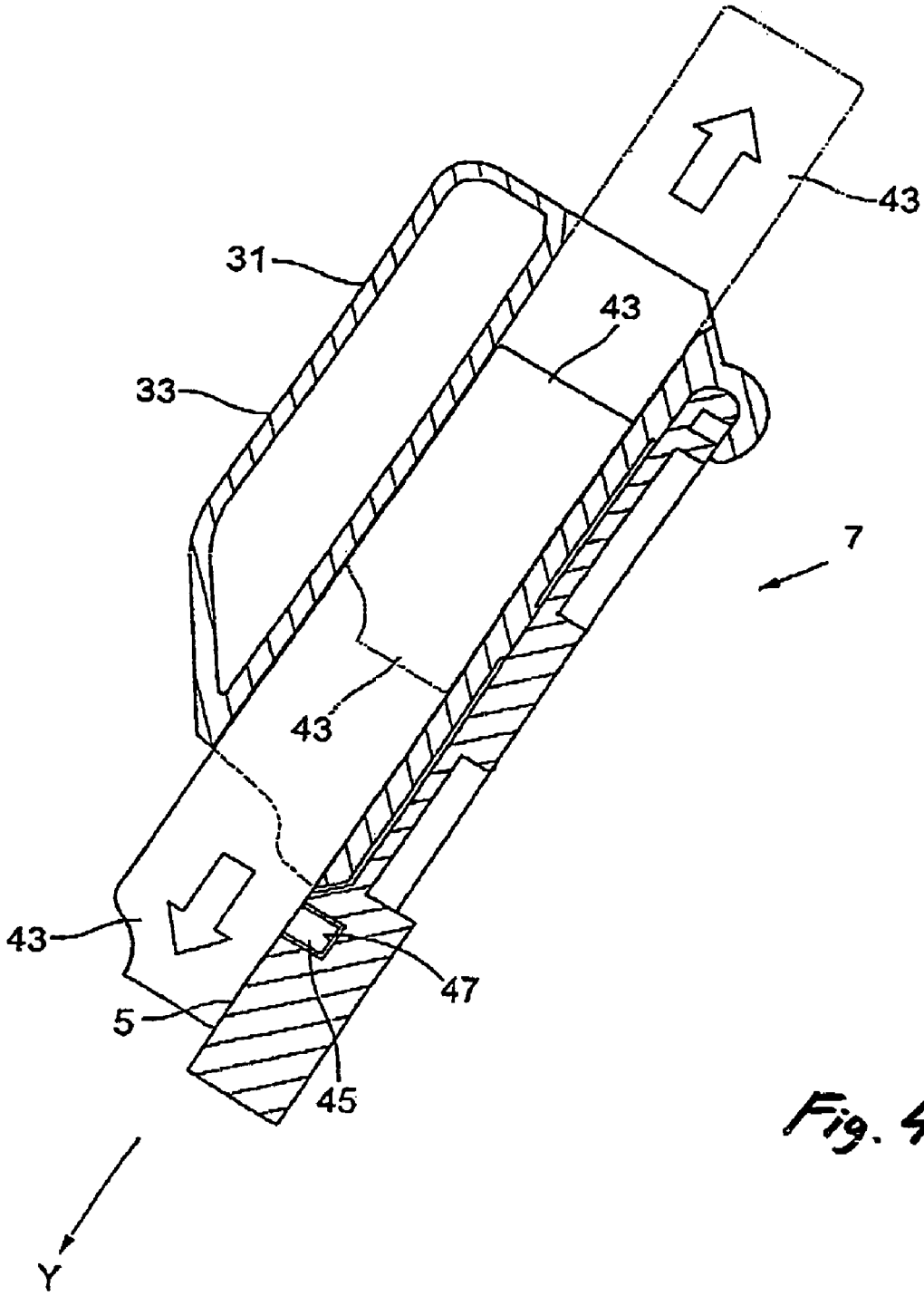
FIG. 4 is a section view taken along a line IV-IV in FIG. 3.

As shown in FIG. 4, the projection 45 can be guided by the groove 47 consisting of the above series of regions. As the projection 45 is guided by the groove 47, its position in the secondary scanning direction Y varies and the auxiliary guide body 43 projects from or retreats into the body 33 accordingly. How the auxiliary guide body 43 projects or retreats will be described below.

Figure 2:
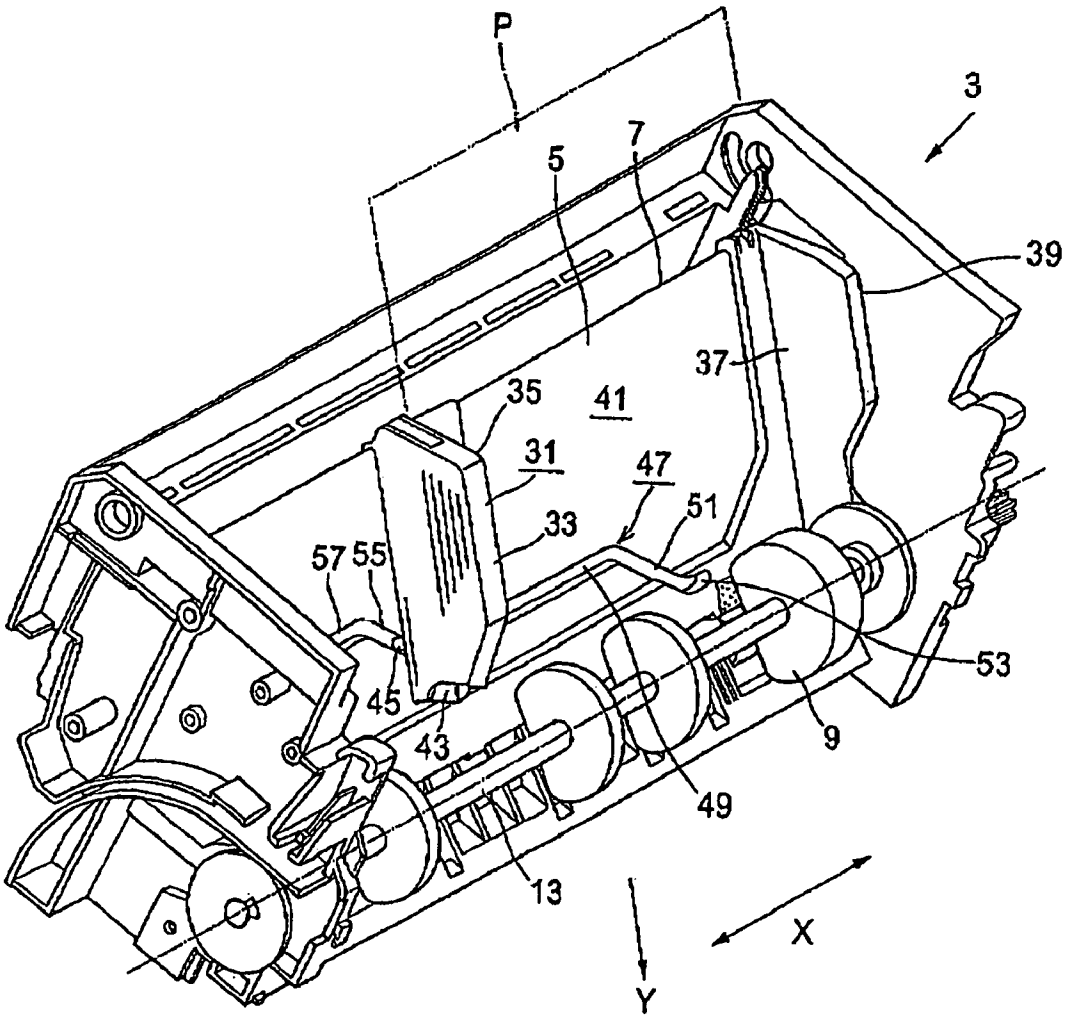
FIG. 2 is a perspective view of the ink jet printer of FIG. 1, showing a state that A4 recording media are to be fed.

FIG. 2 shows a state that the projection 45 is located in the central region 49 when the size of the recording media P is in the range of the A4 to B5 size, As long as the movable edge guide 31 is moved to the right or to the left in the central region 49, the auxiliary guide body 43 does not project from the body 33 in the medium feeding direction nor in the direction opposite to the medium feeding direction.

Figure 5:
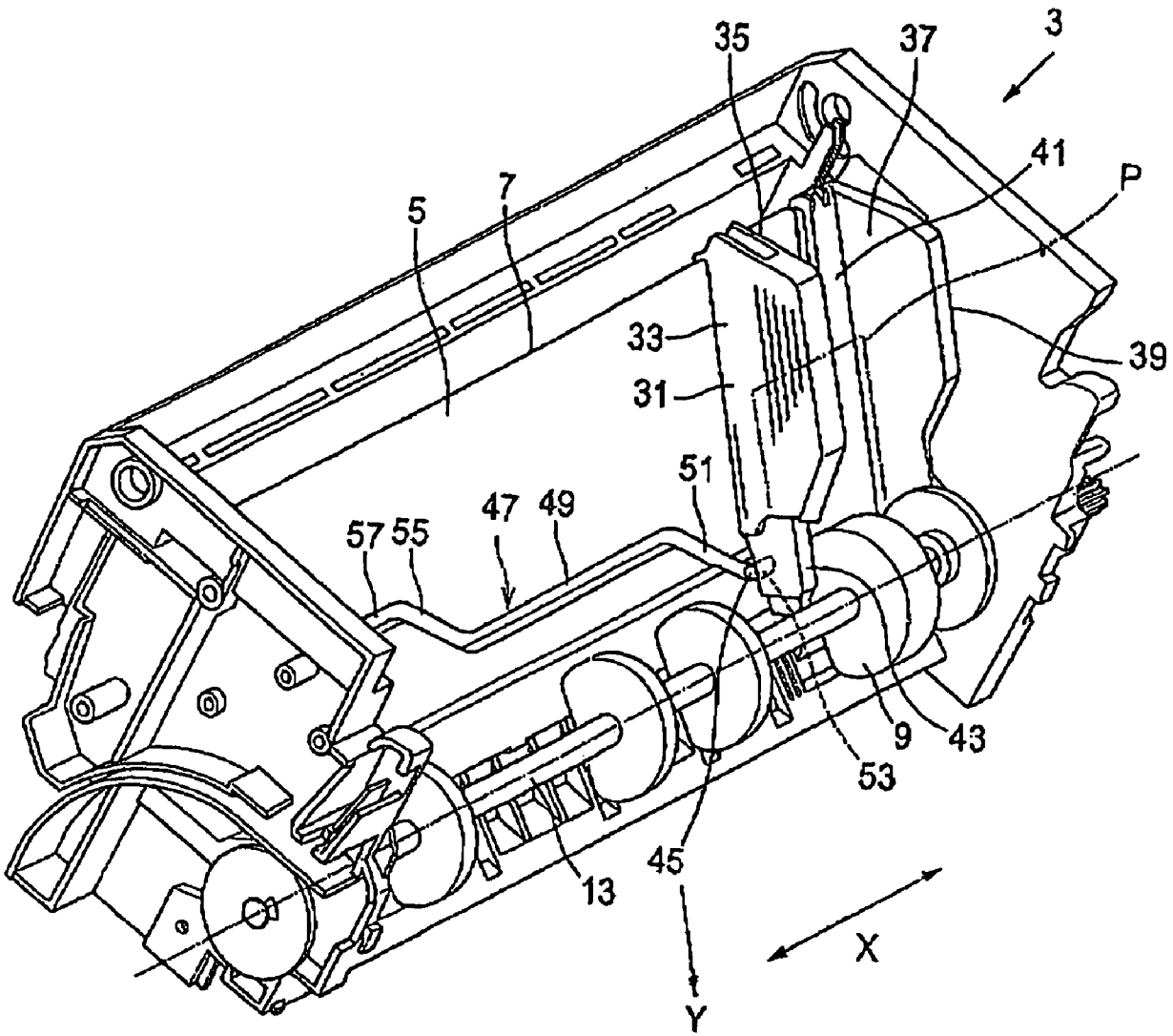
FIG. 5 is a perspective view of the ink jet printer of FIG. 1, showing a state that postcards are to be fed.

FIG. 5 shows a state that the projection 45 is located in the lower stage region 53 when the recording media P are small ones such as post cards or name cards. A transition from the state of FIG. 2 to the state of FIG. 5 is realized by moving the movable edge guide 31 rightward, as a result of which the projection 45 is guided to the lower stage region 53 via the slope region 51 and, at the same time, the auxiliary guide body 43 projects in the medium feeding direction. The auxiliary guide body 43 projects from the body 33 in the medium feeding direction to such a length as to be able to guide the associated side edges of post cards or name cards throughout. Since both side edges of each small recording medium P can be guided reliably until the end of the feeding process, each recording medium P is prevented from being skewed in the feeding process.

Figure 6:
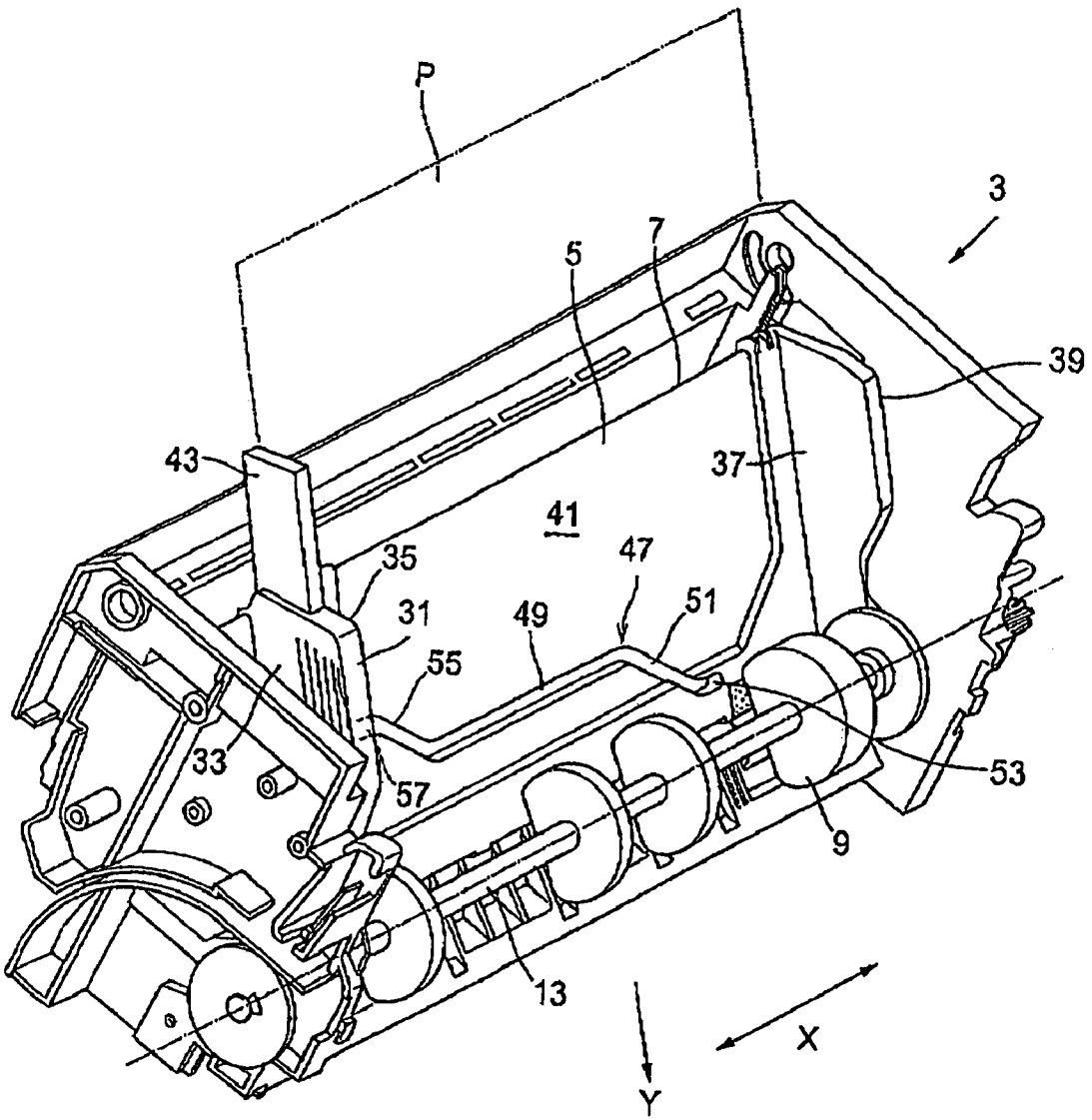
FIG. 6 is a perspective view of the ink jet printer of FIG. 1, showing a state that B4 recording media are to be fed.

FIG. 6 shows a state that the projection 45 is located in the upper stage region 57 when the recording media P are relatively large ones such as B4 or A3 recording media. A transition from the state of FIG. 2 to the state of FIG. 6 is realized by moving the movable edge guide 31 leftward, as a result of which the projection 45 is guided to the upper stage region 57 via the slope region 55 and, at the same time, the auxiliary guide body 43 projects in the direction opposite to the medium feeding direction. Since the auxiliary guide body 43 projects from the body 33 in the direction opposite to the medium feeding direction, both side edges of each relatively large recording medium P can be guided over a great length even at the beginning of the feeding process. Each recording medium P is reliably prevented from being skewed in the feeding process.

In this embodiment, the auxiliary guide body 43 can project in the medium feeding direction and in the direction opposite to it so as to accommodate both of relatively small recording media such as post cards or name cards and relatively large recording media such as B4 or A3 recording media. However, the edge guide member may be configured in such a manner that the auxiliary guide body 43 can project only in the medium feeding direction or the direction opposite to it.

In this embodiment, the auxiliary guide body 43 does not project in the medium feeding direction or the direction opposite to it when recording media of the A4 to B5 size are to be fed. However, the range where the auxiliary guide body 43 does not project may be set arbitrarily.

Next, a second embodiment of the invention will be described. Components similar to those in the first embodiment will be designated by the same reference numerals and repetitive explanations for those will be omitted.

Figure 7:
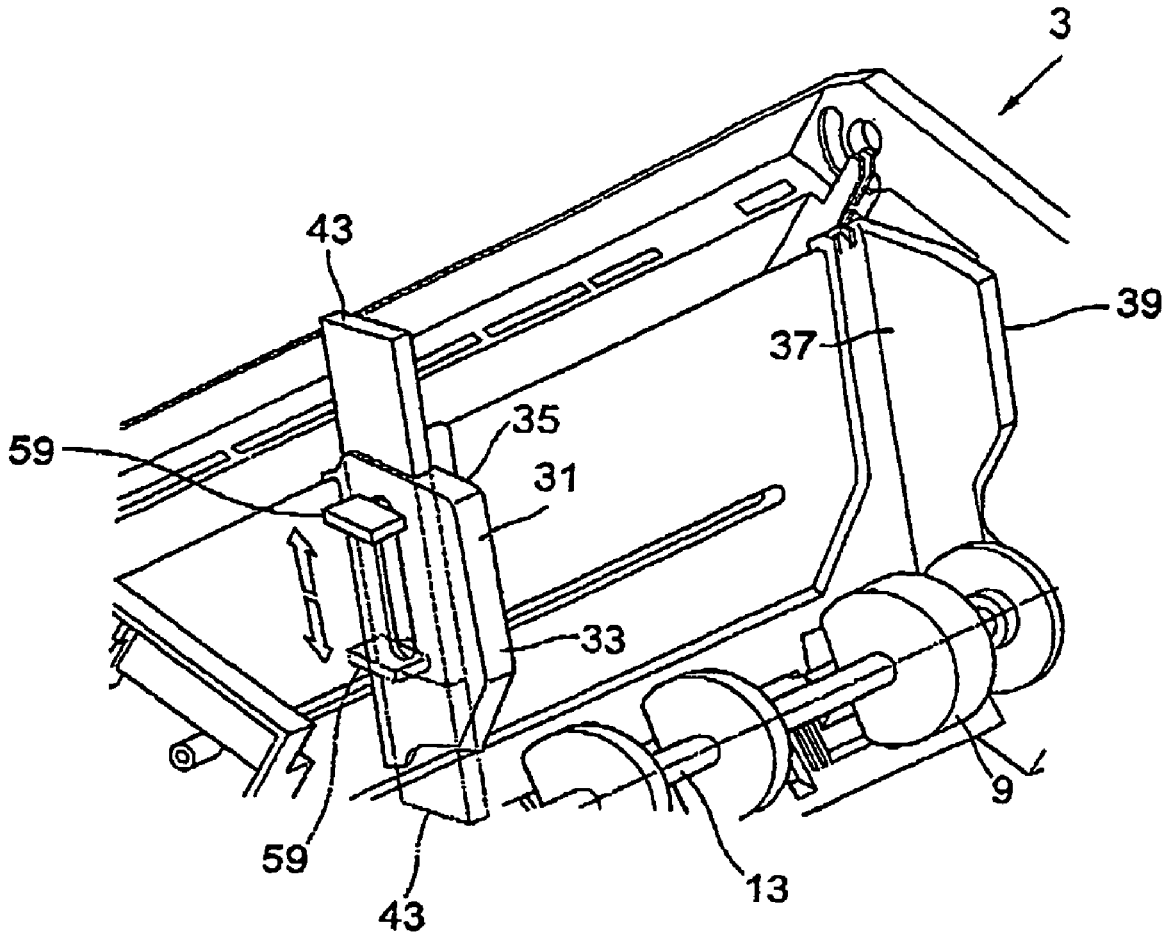
FIG. 7 is a perspective view of a feeder according to a second embodiment of the invention.

In this embodiment, as shown in FIG. 7, the projection 45 and the groove 47 are not provided, and the auxiliary guide body 43 is instead formed with a manipulator 59. The auxiliary guide body 43 can be moved in the medium feeding direction or the direction opposite to it and thereby projected from the body 33 in the medium feeding direction or the direction opposite to it by moving the manipulator 59 in the medium feeding direction or the direction opposite by manipulating the manipulator 59 with fingers.

Next, a third embodiment of the invention will be described. Components similar to those in the first embodiment will be designated by the same reference numerals and repetitive explanations for those will be omitted.

Figure 8:
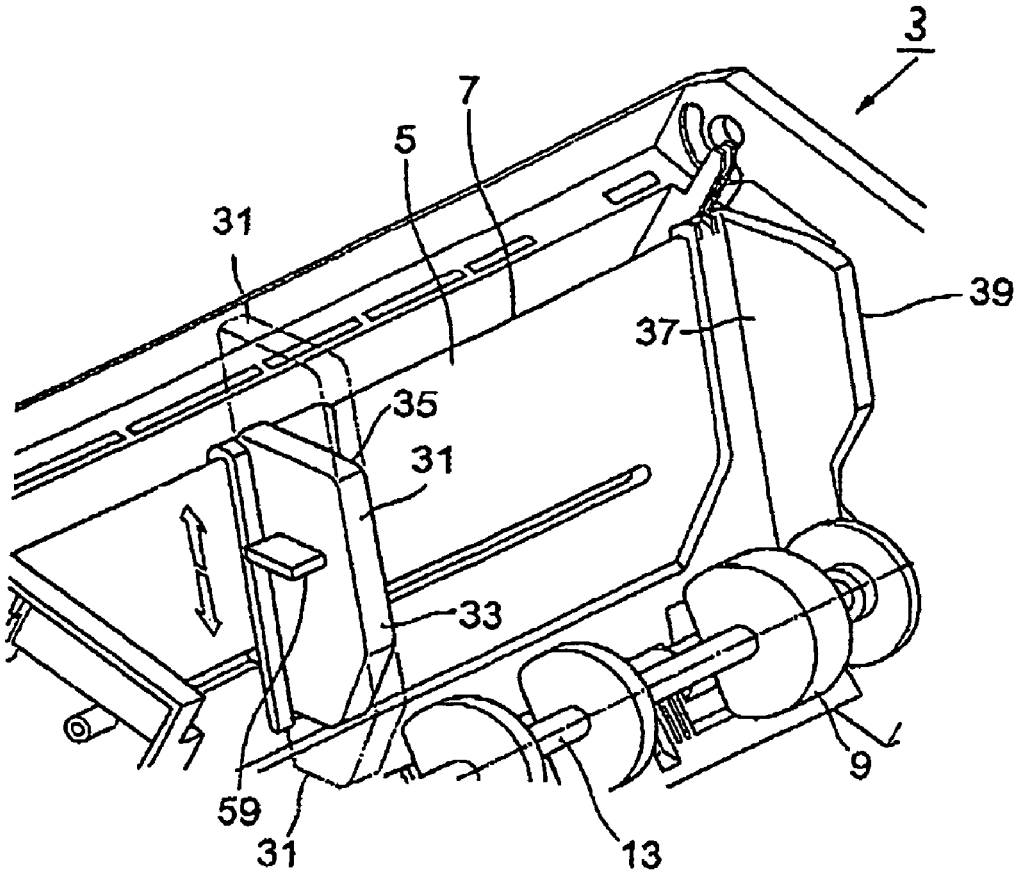
FIG. 8 is a perspective view of a feeder according to a third embodiment of the invention.

In this embodiment, as shown in FIG. 8, the auxiliary guide body 43 is omitted and the movable edge guide 31 itself is moved in the medium feeding direction or the direction opposite to it in accordance with the size of recording media by manipulating a manipulator 59, for example, so that the side edges of recording media can be guided in accordance with their size.

The invention has been described above for the case of feeding recording media such as sheets. However, the invention can likewise be applied to a target medium feeder in an apparatus for causing liquid to land onto a target medium corresponding to a recording medium by electing the liquid to the target medium from a liquid ejecting head instead of the recording head.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A feeder, adapted to feed a medium to a down stream section in a first direction, comprising:

a feeding tray, having a supporting face adapted to support the medium thereon and formed with a groove;

a first edge guide, provided on the supporting face so as to be slidable in a second direction perpendicular to the first direction;

a second edge guide, provided on the supporting face so as to oppose to the first edge guide, so that the medium is placed therebetween; and an auxiliary guide body, provided in the first edge guide and having a projection slidably engaged with the groove, the auxiliary guide body being slidable relative to the first edge guide in the first direction and a third direction opposite to the first direction, in accordance with the slide movement of the first edge guide in the second direction by way of the engagement between the projection and the groove, the auxiliary guide body having a guiding face projected from the first edge guide in the first direction and third direction, wherein the guide face protrudes in the first direction when a distance between the first edge guide and the second edge guide is no greater than a first prescribed value and adapted to be brought into contact with one of the side edges of the medium.

2. The feeder as set forth in claim 1, wherein the first value corresponds to a width of a shorter dimension of a postcard.

3. The feeder as set forth in claim 1, wherein a projected length of the guiding face is varied in accordance with the distance between the first edge guide and the second edge guide.

4. The feeder as set forth in claim 1, wherein the second edge guide is fixed on the supporting face.

5. The feeder as set forth in claim 1, wherein the guiding face is projected from the first edge guide in the third direction when the distance between the first edge guide and the second edge guide is no less than a second prescribed value which is greater than the first prescribed value.

6. A feeder, adapted to feed a medium to a down stream section in a first direction, comprising:

a feeding tray, having a supporting face adapted to support the medium thereon and formed with a groove;

a first edge guide, provided on the supporting face so as to be slidable in a second direction perpendicular to the first direction;

a second edge guide, provided on the supporting face so as to oppose to the first edge guide, so that the medium is placed therebetween; and an auxiliary guide body, provided in the first edge guide and having a projection slidably engaged with the groove, the auxiliary guide body being slidable relative to the first edge guide in the first direction and a third direction opposite to the first direction, in accordance with the slide movement of the first edge guide in the second direction by way of the engagement between the projection and the groove, the auxiliary guide body having a guiding face projected from the first edge guide in the third direction and first direction, wherein the guiding face protrudes in the third direction when a distance between the first edge guide and the second edge guide is no less than a first prescribed value and adapted to be brought into contact with one of the side edges of the medium.

7. The feeder as set forth in claim 6, wherein the first value corresponds to a width of a shorter dimension of a B4 sheet of paper.

8. The feeder as set forth in claim 6, wherein a projected length of the guiding face is varied in accordance with the distance between the first edge guide and the second edge guide.

9. The feeder as set forth in claim 6, wherein the second edge guide is fixed on the supporting face.

10. The feeder as set forth in claim 6, wherein the guiding face is projected from the first edge guide in the first direction when the distance between the first edge guide and the second edge guide is no greater than a second prescribed value which is smaller than the first prescribed value.

* * * * *